US005237293A

United States Patent [19]

Kan et al.

[11] Patent Number: 5,237,293

[45] Date of Patent: Aug. 17, 1993

[54] SELF-TERMINATING COAXIAL CABLE CONNECTOR

[75] Inventors: Ko-Chien Kan; Chin-Chawn Kong; Merry Chen, all of Taipei Hsien, Taiwan

[73] Assignee: Foxconn International, Inc., Sunnyvale, Calif.

[21] Appl. No.: 881,798

[22] Filed: May 12, 1992

[51] Int. Cl.[5] ..... H01P 1/10; H01P 1/26

[52] U.S. Cl. ..... 333/22 R; 200/51.1; 333/260; 333/262; 439/188; 439/578

[58] Field of Search ..... 333/101, 105, 22 R, 333/260, 262; 200/51.09, 51.1, 504; 439/188, 578

[56] References Cited

U.S. PATENT DOCUMENTS 2,640,118 5/1953 Werner ..... 333/22 R 3,360,747 12/1967 Lancaster ..... 333/105

3,525,056 8/1970 Qurashi ..... 333/22 R 4,575,694 3/1986 Lapke et al. ..... 333/25 R 4,971,569 11/1990 Gooch et al. ..... 333/22 R X

*Primary Examiner*—Paul Gensler

*Attorney, Agent, or Firm*—Marks & Murase

[57] ABSTRACT

A connector for use in connecting coaxial cables having a center conductor surrounded by an insulator and a shield is provided with a self-terminating mechanism. The self-terminating mechanism includes a terminating element having an impedance equal to the characteristic impedance of the coaxial cable. The terminating element is arranged within the insulator in such a way that when the connector is uncoupled the terminating element connects the center conductor to the shield, and when the connector is coupled the terminating element is forced off connection with the center conductor.

7 Claims, 9 Drawing Sheets

SELF-TERMINATING COAXIAL CABLE CONNECTOR

BACKGROUND OF THE INVENTION

1. Field of the Invention

The present invention relates to coaxial cable connectors, and more particularly, to a coaxial cable connector having self-terminating capability when it is uncoupled.

2. Description of Prior Art

Cable lines used for the transmission of high-frequency signals, such as in the range of microwave, often present characteristic impedances. The characteristic impedance is an impedance that would be presented at the input terminals of a transmission line as if the transmission line were infinitely long. For a transmission line having finite lengths, if the end of the transmission line is open circuited, or short circuited, the high-frequency signals that are transmitted through the transmission line would be reflected back from the end to the input end.

To solve the reflection problem, a terminating element having an impedance equal to the characteristic impedance of the transmission line is employed to be coupled at the end of the transmission line to terminate the open circuit. Such a terminated circuit is technically referred to as "a matched circuit" in the art of microwave engineering. A matched circuit would minimize reflections of microwave signals from an interface between two different electrical elements. For transmission lines used in microwave applications, the characteristic impedance thereof is typically 50 Ω. Therefore, a terminating element having an impedance of 50 Ω, in practice a resistor of 50 Ω, can be used to terminate the transmission line.

Transmission lines for use in microwave applications are often manufactured into coaxial cables having a center conductor surrounded by an insulator and a conducting shield. The conducting shield acts both as a shield of electromagnetic radiation from the center conductor and as a ground.

At the end of such a coaxial cable is there provided a connector for coupling with other installations. An exemplary example of such a connector is illustrated in FIGS. 1A-1B and designated by the numeral "1".

The connector is comprised of a center connecting element 10, an insulator 20, and a casing 30. The center connecting element 10 is connected to the center conductor of the coaxial cable. The casing 30 is made of conductors and connected to the shield of the coaxial cable.

When the coaxial cable is used to connect, for example, a microwave signal generator to a spectrum analyzer, the characteristic impedance of the coaxial cable is matched with impedances built in the spectrum analyzer. However, when the coaxial cable is uncoupled from the spectrum analyzer, the end of the coaxial cable will be left with an open circuit.

Conventionally, as shown in FIGS. 1B-1C, a separate screw-type terminating head 50 can be used to terminate the open-circuited coaxial cable. The terminating head 50 is provided with a resistor 51 having a resistance value equal to the characteristic impedance of the coaxial cable. The resistance value is typically 50 Ω or 75 Ω. The terminating head 50 has casing 52 made of conductive material. The resistor 51 is connected to the casing 52 of the terminating head 50. When the terminating head 50 is screwed to the connector the casing 52 thereof is electrically connected with the housing 30 of the connector whereby the end of the center conductor of the coaxial cable is connected via the resistor 51 to the ground. The coaxial cable is thus terminated. Since the terminating head 50 is a separate device, it is often inconvenient to use.

As a consequence, a self-terminating coaxial cable capable of automatically switching the end thereof to a terminated condition when the coaxial cable is left uncoupled is desired. The terminated condition is defined as a condition under which the center conductor of the coaxial cable is connected via an element of matched impedance to the conducting shield of the same.

Among the prior art self-terminating connectors for use with coaxial cables, one type is disclosed in a U.S. Pat. No. 4,575,694 to Lapke et al.

SUMMARY OF THE INVENTION

It is a primary object of the present invention to provide a self-terminating coaxial cable connector.

In accordance with the object of the present invention, a coaxial cable connector is provided with a terminating element having an impedance $Z_1$ equal to the characteristic impedance $Z_0$ of the first transmission line. The terminating element has a first end in electrical connection with a conducting member and a second end connected to the ground. The other end of the conducting member is in electrical connection with the center conductor of the coaxial cable.

When the connector in accordance with the present invention is coupled, the connection between the terminating and the conducting member is disengaged and whereby the terminating element is idled. And when the connector is uncoupled, by means of a resilient force of the conducting element, the conducting element is reconnected with the terminating element and whereby the coaxial cable is terminated.

BRIEF DESCRIPTION OF THE DRAWINGS

The present invention can be more fully by reading the subsequent detailed description of the preferred embodiments thereof with references made to the accompanying drawings, wherein:

FIGS. 1A-1C are illustrations showing a conventional connector and a conventional terminating head, wherein FIG. 1A shows an exploded perspective view of the conventional connector, FIG. 1B shows a cut-away side view of the conventional connector, and FIG. 1C shows a cut-away side view of the conventional connector coupled with the conventional terminating head;

DETAILED DESCRIPTION OF THE PREFERRED EMBODIMENTS

First Preferred Embodiment

Figure 1A:
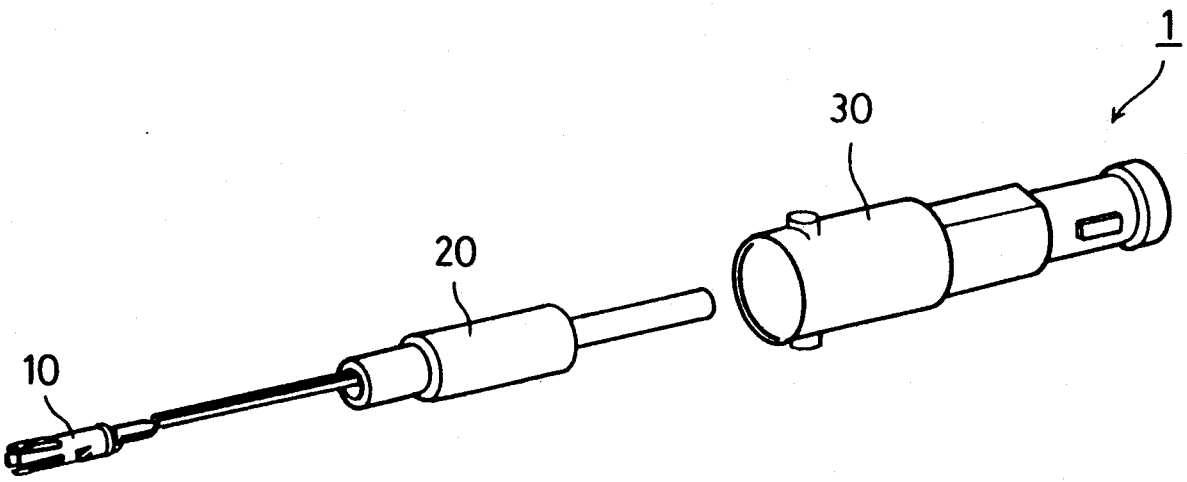
FIG. 1A (PRIOR ART)
Figure 1B:
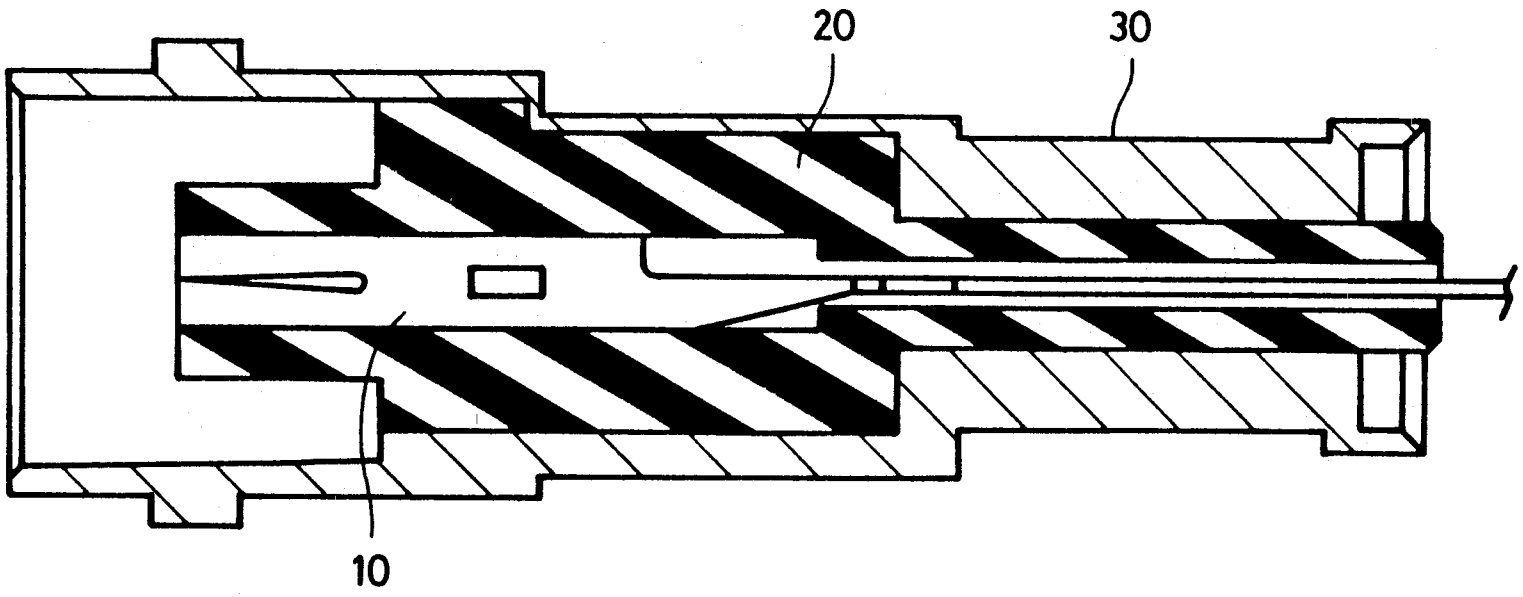
FIG. 1B (PRIOR ART)
Figure 1C:
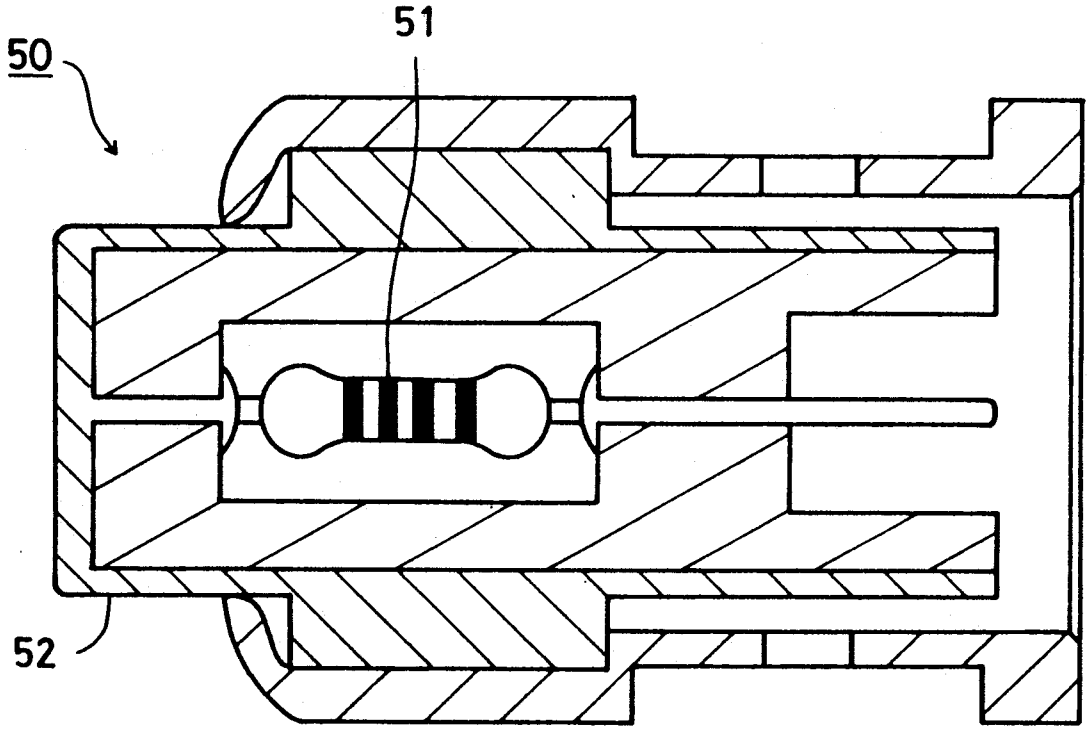
FIG. 1C (PRIOR ART)
Figure 2:
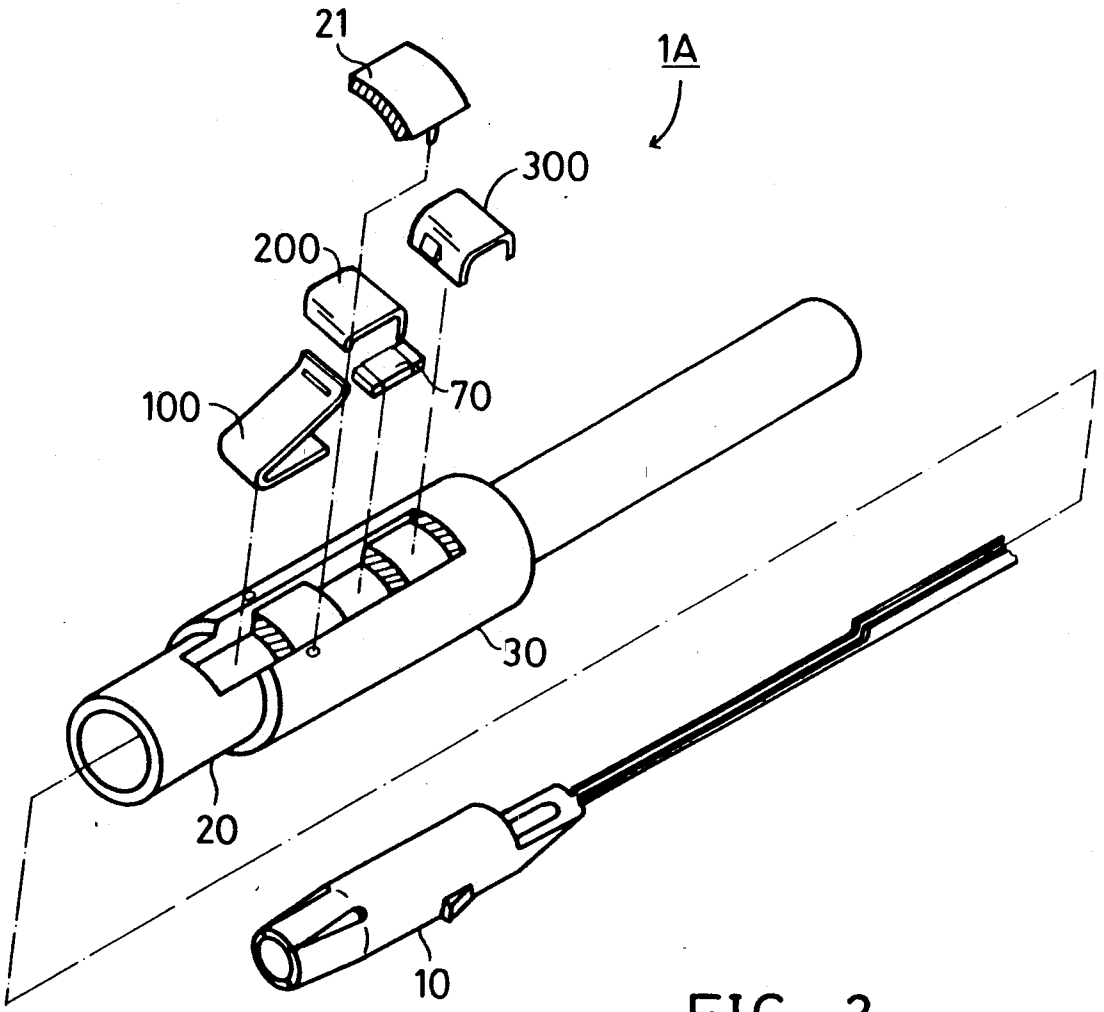
FIG. 2 shows an exploded perspective view of a connector designed in accordance with a first preferred embodiment of the present invention.

FIG. 2 shows an exploded perspective view of a connector 1A designed in accordance with a first preferred embodiment of the present invention. The structure of the connector 1A is essentially the same as that of the conventional connector shown in FIGS. 1A–1B except that a self-terminating mechanism is provided thereto. Those parts of the connector 1A that are unchanged in view of the conventional connector I are hereinafter labelled with the same reference numerals.

Figure 3:
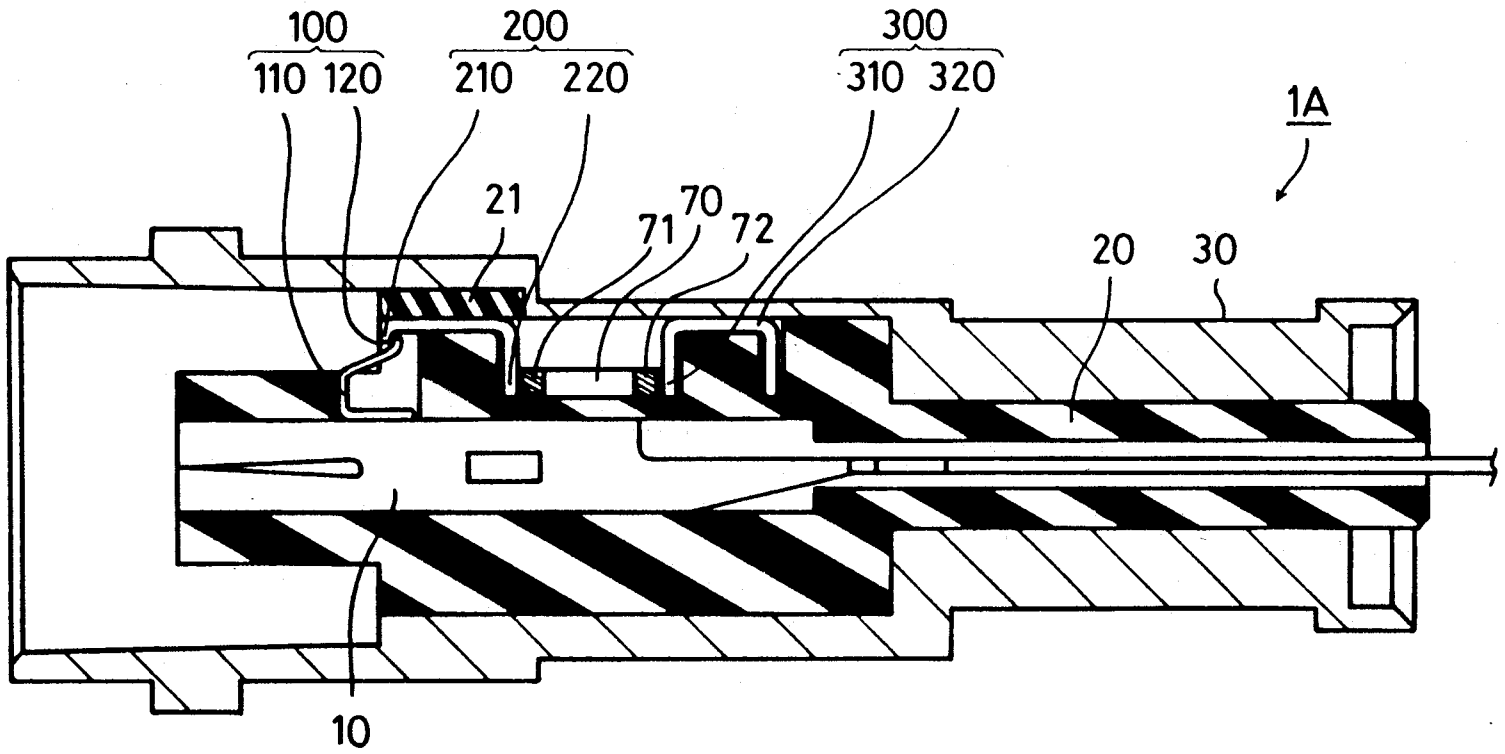
FIG. 3 is a cut-away side view of the connector of FIG. 2.

Referring concurrently to FIGS. 2 and 3, the self-terminating mechanism is constructed by a first conducting member 100, a second conducting member 200, a third conducting member 300 and a chip resistor-. 70. The first conducting member 100 is particularly made with a good resilient characteristic, i.e. if the first conducting element 100 is slightly bent, the resilient force thereof would restore its original shape.

The chip resistor 70 has a resistance value equal to the characteristic impedance of the coaxial cable. Portions of the insulator 20 are hollowed to provide four separate spaces for accommodating respectively the first conducting member 100, the second conducting member 200, the chip resistor 70, and the third conducting member 300.

As shown in FIG. 3 in which the connector 1A is uncoupled, the third conducting member 300 has a portion 320 in secured electrical connection with the housing 30 of the connector 1A and an end 310 in secured electrical connection with the chip resistor 70.

The second conducting member 200 has an end 220 in secured electrical connection with the chip resistor 70 and the other end 210 slightly hooked. An insulator pad 21 is disposed above the second conducting member 200 to prevent the second conducting member 200 from electrical contact with the casing 30. The first conducting member 100 has one end 11? in secured electrical connection with the center connecting member 10 of the connector 1A and the other end 120 in detachable electrical contact with the hooked end 210 of the second conducting member 200. In summary, all the connections related to the first conducting member 100, second conducting member 200, and third conducting member 300 are secured connections except that between the first conducting member 100 and the second conducting member 200.

Figure 4:
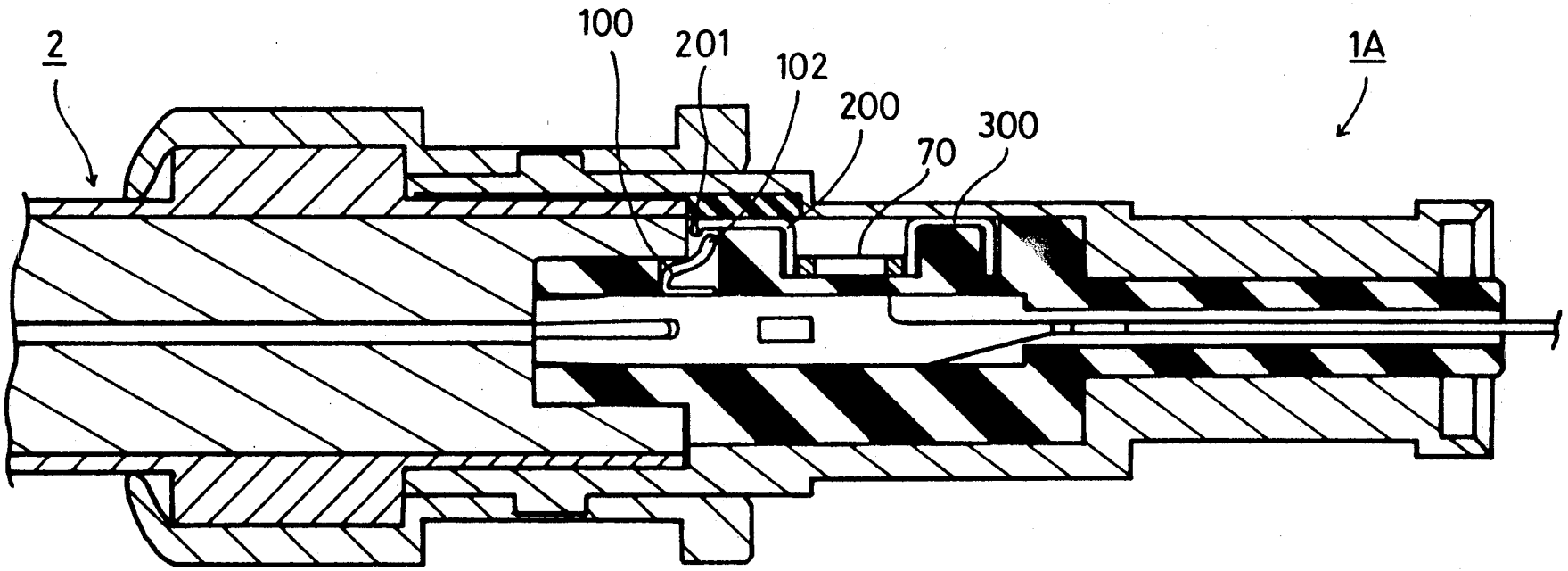
FIG. 4 is a cut-away side view of the connector of FIG. 2 coupled with another coaxial cable.

Referring further to FIG. 4, when the connector 1A is coupled with a mating connector 2 of another coaxial cable, a portion of the first conducting member 100 near the end 120 is pushed by a protruding member of the mating connector 2 and whereby the electrical contact between the first conducting member 100 and the second conducting member 200 is disengaged. Accordingly with this mechanism, the chip resistor 70 is idled when the connector 1A is coupled.

When the connector 1A is again uncoupled, i.e. the mating connector 2 is pulled out therefrom, the first conducting member 100 is released from pressing and thus the original shape thereof is restored due to the resilient force. As a result, the first conducting member 100 and the second conducting member 200 is again in electrical contact and whereby the connector 1A is automatically "self-terminated".

Second Preferred Embodiment

Figure 5:
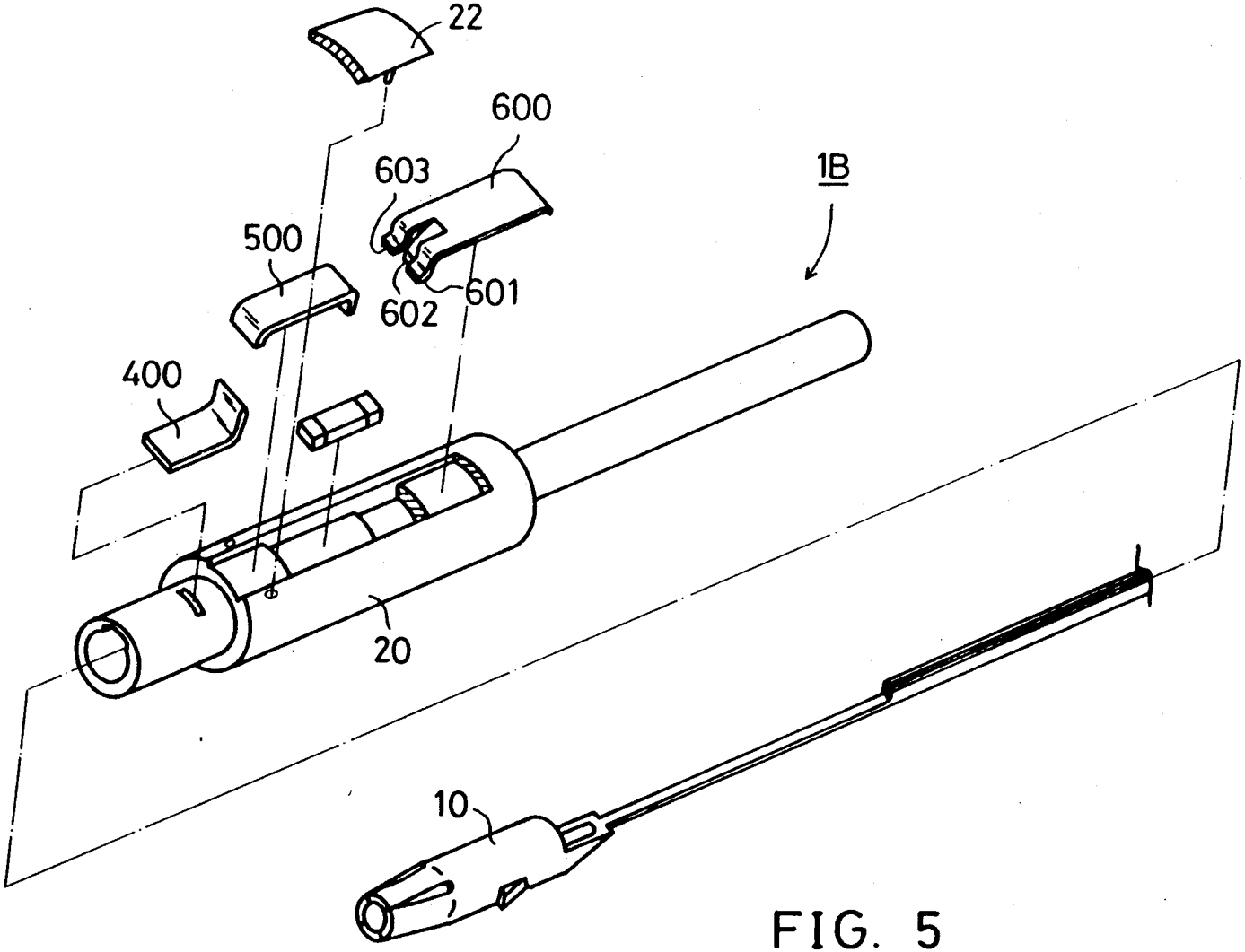
FIG. 5 shows an exploded perspective view of a connector designed in accordance with a second preferred embodiment of the present invention.
Figure 6:
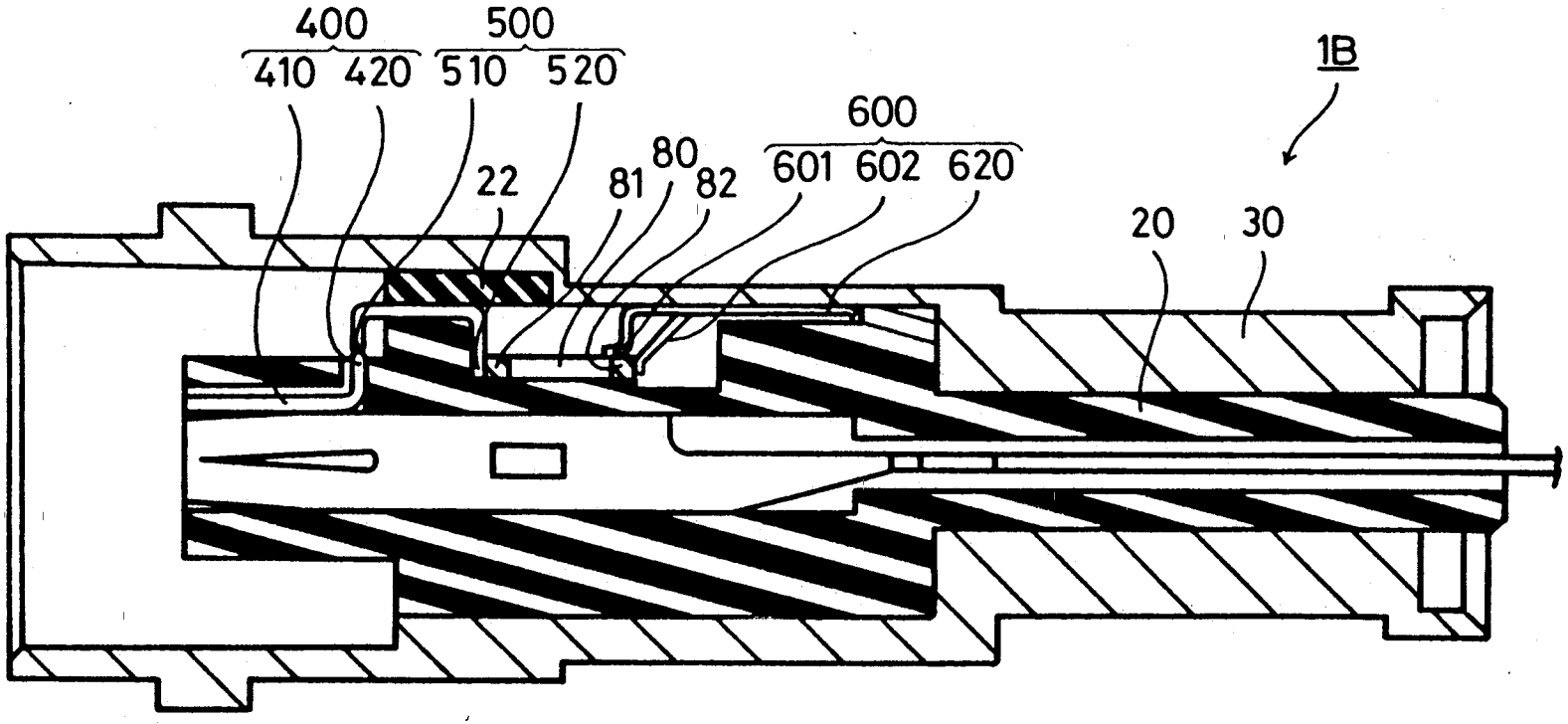
FIG. 6 is a cut-away side view of the connector of FIG. 5.

Referring to FIGS. 5–6, a connector 1B with the self-terminating mechanism thereof constructed in accordance with a second preferred embodiment of the present invention is shown. The self-terminating mechanism is comprised of a fourth conducting member 400, a fifth conducting member 500, a sixth conducting member 600 and a chip resistor 80. One end of the sixth conducting member 600 is cut into three legs, a first leg 601, a second leg 602, and a third leg 603, and shaped as shown in FIG. 5. The sixth conducting member 600 is particularly made with a good resilient characteristic, i.e. if the second leg 602 thereof is slightly bent, the resilient force thereof would restore the second leg 602 to its original position.

The sixth conducting member 600 has a portion 620 in electrical contact with the housing 30 of the connector 1B. The first leg 601 and the third leg 603 of the sixth conducting member 600 are positioned, as viewed from FIG. 6, on the top of one end 82 of the chip resistor 80 but are not in secured contact with the same; while the second leg 602 of the sixth conducting member 600 is in secured electrically connection with the side of the end 82 of the chip resistor 80.

The other end 81 of the chip resistor 80 is in secured electrical connection with one end 520 of the fifth conducting member 500. An insulator pad 22 is disposed above the fifth conducting member 500 to prevent the fifth conducting member 500 from electrical contact with the casing 30. As shown in FIG. 6, when the connector 1B is uncoupled, the other end 510 of the fifth conducting member 500 is in electrical contact with one end 420 of the fourth conducting member 400. Contrarily, the other end 410 of the fourth conducting member 400 is in secured electrical connection with the center connecting element 10 of the connector 1B.

Figure 7:
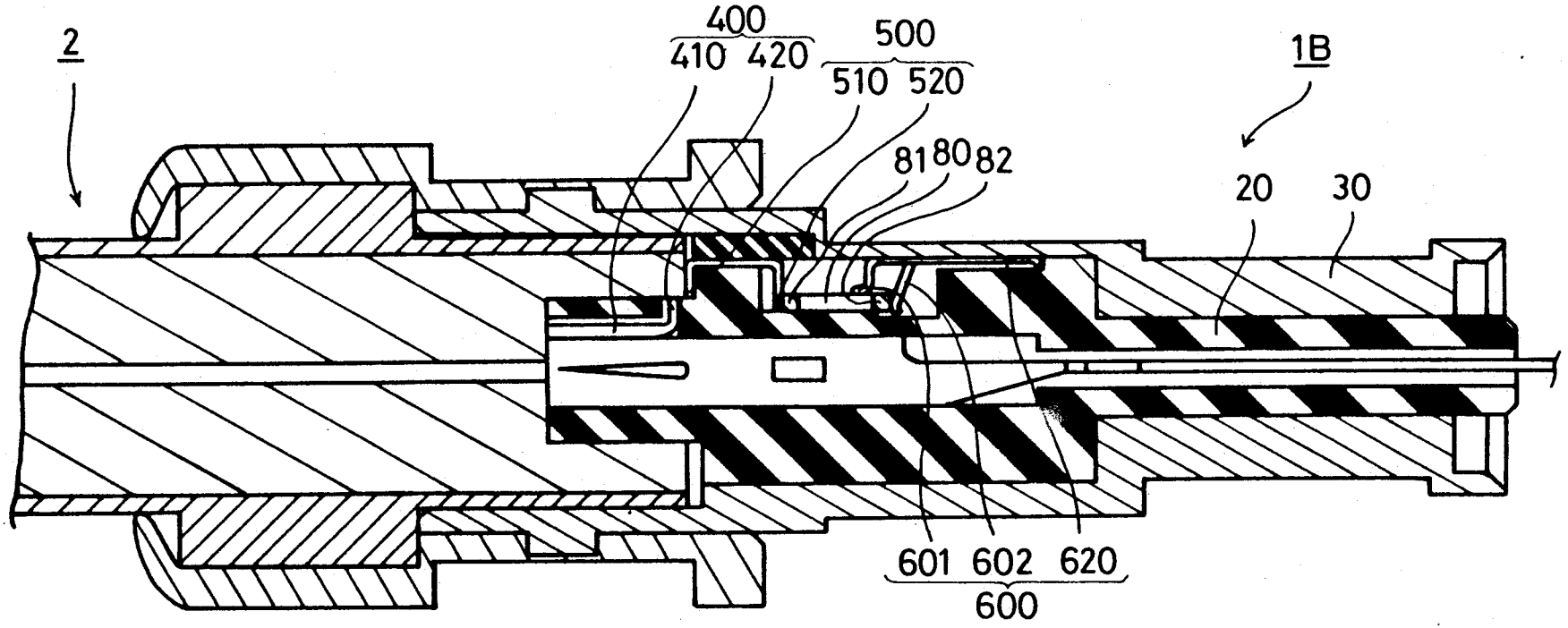
FIG. 7 is a cut-away side view of the connector of FIG. 5 coupled with another coaxial cable.

When the connector 1B is coupled to the mating connector 2 as shown in FIG. 7, the protruding member of the mating connector 2 exerts a force upon the fifth conducting member 500 and since the second leg 602 of the sixth conducting member 600 is resilient, the fifth conducting member 500 as well as the chip resistor 80, as seen from the side view of FIG. 7, are pushed to the right. The displacement of the fifth conducting member 500 causes a disconnection between itself and the fourth conducting member 400, thereby idling the chip resistor 80.

When the connector 1B is uncoupled, i.e the mating connector 2 is removed, the restoring resilient force of the second leg 602 of the sixth conducting member 600 pushes the chip resistor 80, as well as the fifth conducting member 500, back to their original positions. As a result, the end 510 of the fifth conducting member 500 is reconnected with the end 420 of the fourth conducting member 400, thereby reconnecting the center connecting element 10 of the connector 1B via the chip resistor 80 to the ground. The connector 1B is thus automatically self-terminated.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A self-terminating connector provided at the end of a first transmission cable line having a characteristic impedance $Z_0$ for connecting the first transmission cable line to a second transmission cable lien, the first transmission cable line and the second transmission cable line including a first second conducting line for transmitting electrical signals and a second conducting line connected to the ground, said self-terminating connector comprising:

(a) means for coupling the first transmission cable line to the second transmission cable line;

(b) a first conducting member having a first end and a second end, said first conducting member being made of resilient material, the first end of said first conducting member being secured for movement with and in electrical connection with the first conducting line of the first transmission cable line and the second end of said first conducting member being arranged at a predetermined first position, the second end of said conducting member being deflected so as to move relative to the first end of the first conducting member and the first transmission cable line to a predetermined second position when the first transmission cable line is coupled with the second transmission cable line and capable of moving relative to the first end of the first conducting member back to the first predetermined position due to the resilient force of the first conducting member when the first transmission cable line is uncoupled;

(c) a second conducting member having a first end and a second end, the first end of said second conductive member being in electrical connection with said first conducting member when the second end of said first conductive member resides at the first predetermined position and in electrical isolation with said first conductive member when the second end of said first conductive member is forced to reside at the second predetermined position;

(d) a terminating element having an impedance $Z_1$ equal to the characteristic impedance $Z_0$ of the first transmission cable line, said terminating element having a first end and a second end, the first end of said terminating member being in electrical connection to the second end of said second conductive member; and (e) a third conductive member electrically connecting the second end of said terminating element to the second conductive line of the first transmission cable line.

2. A self-terminating connector provided at the end of a first transmission cable line having a characteristic impedance $Z_0$ for connecting the first transmission cable line to a second transmission cable line, the first transmission cable line and the second transmission cable line including a first conducting line for transmitting electrical signals and a second conducting line connected to the ground, said self-terminating connector comprising:

(a) means for coupling the first transmission cable line to the second transmission cable line, said coupling means having an enclosed space for accommodating the end of the second transmission cable line;

(b) a first conducting member having a first end and a second end, said first conducting member being made of resilient material, the second end of said first conducting member being electrically connected to the second conducting line of the first transmission cable line, the first end of said first conductive member being provided with a resilient finger;

(c) a terminating element having an impedance $Z_1$ equal to the characteristic impedance $Z_0$ of the first transmission cable line, said terminating element having a first end and a second end, the second end of said terminating member being in secured electrical connection to said resilient finger of said first conductive member;

(d) a second conductive member having a first end and a second end, the second end of said second conductive member being in electrical connection with the first end of said terminating element and the first end of said second conductive member being disposed at a first predetermined position within the enclosed space of said coupling means, the first end of said second conductive member being pushed to a second predetermined position when the first transmission cable line is coupled with the second transmission line and capable -of moving back to the first predetermined position due to the resilient force of said resilient finger of said first conductive member;

(e) a third conductive member having a first end and a second end, the first end of said third conductive member being in electrical connection with the first conducting line of the first transmission line, and the second end of said third conductive member being in electrical contact with said second conductive member when the first end of said second conductive member resides at the first predetermined position and in electrical isolation with said second conductive member when the first end of said second conductive member resides at the second predetermined position.

3. A self-terminating connector provided at the end of a first transmission cable line having a characteristic impedance $Z_0$ for connecting the first transmission cable line to a second transmission cable line, the first transmission cable line and the second transmission cable line each including a first conducting line for transmitting electrical signals and a second conducting line connected to the ground, the self-terminating connector comprising: a first conducting member having a first end and a second end, the second end of the first conducting member being electrically connected to the second conducting line of the first transmission cable line; a terminating element having an impedance $Z_1$ equal to the characteristic impedance $Z_0$ of the first transmission cable line, the terminating element having a first end and a second end, the second end of the terminating member being in secured electrical connection to the first end of the first conducting member; and a second conducting member, the second conducting member having a first end and a second end, the second end of the second conducting member being in electrical connection with the first end of the terminating element; a third conducting element having a first end and a second end, the first end of the third conducting member being in electrical connection with the first conducting line of the first transmission line, and at least one of the first conducting member, the second conducting member and the third conducting member being resiliently deformable so as to allow relative movement between the first end of the second conducting member and the second end of the third conducting member; whereby the second end of the third conducting ember is in electrical connection with the first end of the second conducting member when the first transmission cable line and the second transmission cable line are uncoupled and the third conducting member and second conducting member are in electrical isolation when the first transmission cable line and the second transmission cable line are coupled.

4. The self-terminating connector of claim 3, wherein the first end of the first conducting member is provided with a resilient finger.

5. The self-terminating connector of claim 4, wherein the second end of the terminating member is secured in electrical connection to the resilient finger of the first conducting member.

6. The self-terminating connector of claim 5, wherein the first end of the second conducting member is disposed at a first predetermined position and is pushed to a second predetermined position when the first transmission cable line is coupled with the second transmission cable line and wherein the movement of the second conducting member from the first predetermined position to the second predetermined position causes resilient deformation of the resilient finger provided on the first conductor member.

7. The self-terminating connector of claim 3, wherein the second end of the third conducting element is resiliently deformable relative to the first end of the third conducting member so as to allow movement of the second end of the third conducting member away from the first end of the second conducting member so as to place the third conducting member and second conducting member in electrical isolation when the first transmission cable line and the second transmission cable line are coupled.

* * * * *